United States Patent [19]

Stribiak, Jr.

[11] 4,104,812

[45] Aug. 8, 1978

[54] SNOW BLOWER FOR POWERED LAWN MOWERS

[75] Inventor: John J. Stribiak, Jr., 18632 Poplar, Homewood, Ill. 60430

[73] Assignees: John J. Stribiak, Jr.; John Swanson

[21] Appl. No.: 784,964

[22] Filed: Apr. 6, 1977

Related U.S. Application Data

[63] Continuation-in-part of Ser. No. 731,950, Oct. 12, 1976, abandoned.

[51] Int. Cl.[2] ..... E01H 5/00

[52] U.S. Cl. ..... 37/43 L; 56/DIG. 9; 56/DIG. 18

[58] Field of Search ..... 37/43 L, 43 R, 43 A–43 K, 37/53; 56/2, 239, 249.5, DIG. 9, DIG. 18

[56] References Cited

U.S. PATENT DOCUMENTS

| | | | |
|---|---|---|---|
| 2,476,526 | 7/1949 | Badlat | 37/53 |
| 2,768,453 | 10/1956 | Adams, Jr. | 37/53 X |
| 2,770,894 | 11/1956 | Gettleman | 37/43 R |
| 2,797,502 | 7/1957 | Griffith et al. | 37/43 L |
| 3,673,776 | 7/1972 | Smith | 37/43 L |
| 3,690,047 | 9/1972 | Thoen et al. | 37/43 L |
| 3,691,860 | 9/1972 | Danuser | 37/43 R |
| 3,748,675 | 7/1973 | Schultz | 37/43 L X |
| 3,774,321 | 11/1973 | David | 37/43 L |
| 3,986,414 | 10/1976 | Peterson et al. | 37/43 R X |

*Primary Examiner*—E. H. Eickholt

[57] ABSTRACT

A snow blower adapter for mounting on a powered lawn mower including a housing to receive snow therein and chute means in cooperation with conveyor means to discharge snow from the housing, means to drive the conveyor means including a transmission and a clutch to operatively engage and disengage the transmission from the lawn mower and means for mounting the adapter on the lawn mower, including a pair of elongate arms adapted to be releasably mounted on the lawn mower.

15 Claims, 25 Drawing Figures

FRONT VIEW

TOP VIEW

SIDE VIEW

SNOW BLOWER FOR POWERED LAWN MOWERS

This is a continuation-in-part of copending application Ser. No. 731,950, filed Oct. 12, 1976 now abandoned.

This invention relates to snow blowing equipment and more particularly to a snow blower adapter capable of being mounted on a conventional, powered lawn mower.

Snow blowing equipment for home use has been in widespread use for many years. One of the difficulties associated with such equipment is that it is only used during a relatively limited part of the year, and yet represents a substantial investment. Thus, it is desirable to provide snow blowing equipment which is more flexible, being capable of use with other home equipment.

It has been proposed, in U.S. Pat. Nos. 2,735,199, 3,131,491, 3,319,363, 3,774,321 and 3,882,615, to provide a snow blowing attachment for conventional power-driven lawn mowers. In that way, the snow blowing attachment can be mounted on the lawn mower for use during the winter, and then the lawn mower can be returned to lawn service at the end of the winter. Only one major piece of equipment is thus necessary to have both a lawn mower and snow blowing equipment.

One of the difficulties with the snow blowing equipment described in the foregoing attachments stems from the fact that they are quite difficult to attach to a lawn mower, requiring the use of elaborate mounting brackets and the like. Thus, it becomes a major project to convert a mower for use in snow blowing applications. Another disadvantage of the device described in the foregoing patents stems from the fact that all derive their power directly from the lawn mower. This results in a loss of efficiency due to the fact that the lawn mower runs at a higher speed, and hence lower torque, than is required for most snow blowing applications.

It is accordingly an object of the present invention to provide a snow blowing adapter for use on a conventional, power-driven lawn mower which overcomes the foregoing disadvantages.

It is a more specific object of the invention to provide a snow blowing equipment for use in conventional lawn mowers which can be mounted thereon with relative ease and which is capable of efficiency utilizing the power supplied by the lawn mower.

These and other objects and advantages of the invention will appear more fully hereinafter, and, for purposes of illustration but not of limitation, the embodiment of the invention is shown in the accompanying drawing wherein.

The concepts of the present invention reside in a snow blower adapter for use with a conventional, powerdriven lawn mower which is formed of a housing having mounting brackets mounted thereon, adapted to mount in a single and effective manner to a lawn mower and a transmission assembly adapted to be operatively connected to the motor of the lawn mower to transmit the power from the lawn mower motor to the snow blower adapter. It has been found that the snow blower adapter of the present invention can be quickly mounted on the lawn mower, and the power of the lawn mower effectively utilized by reason of the self-contained transmission on the snow blower adapter.

Figure 1:
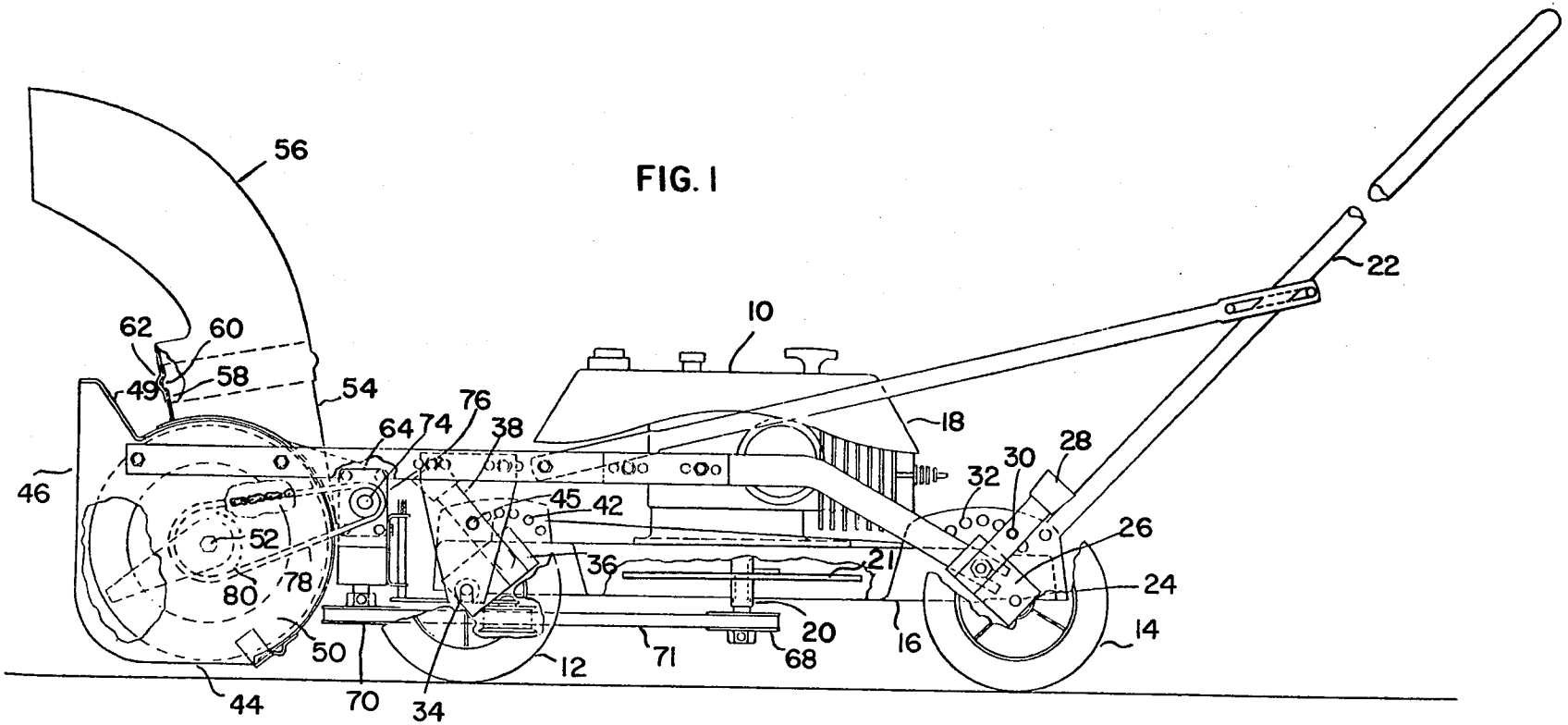
FIG. 1 is a side view in elevation of a snow blowing adapter embodying the features of this invention, mounted on a conventional lawn mower.

Referring now to the drawings for a more detailed description of the invention, there is shown in FIG. 1 a power-driven lawn mower 10, provided with a pair of forward wheels 12 and rearward wheels 14 carrying the chassis of the mower 16. The mower includes power means 18 which can be either a gasoline engine or an electric motor to drive a shaft 20 to which the mower blade is normally attached. The mower 10 also includes handle means 22 with which the mower is guided.

As is shown in FIG. 1 of the drawing, the rear wheels 14 are mounted by means of an axle 24 on a flange member 26, the height of which is regulated by means of a control lever 28. As is well known to those skilled in the art, the control lever includes a movable pin 30 which is adapted to engage one of a series of openings 32 to permit the elevation of the chassis 16 to be changed in accordance with conventional techniques.

Similarly, a like arrangement is provided on the forward wheels. They are mounted by means of an axle 30 on a forward flange member 36, also equipped with a control arm 38 whereby the control arm includes a movable pin 40 adapted to engage one of a series of elevation-control openings 42.

Figure 2:
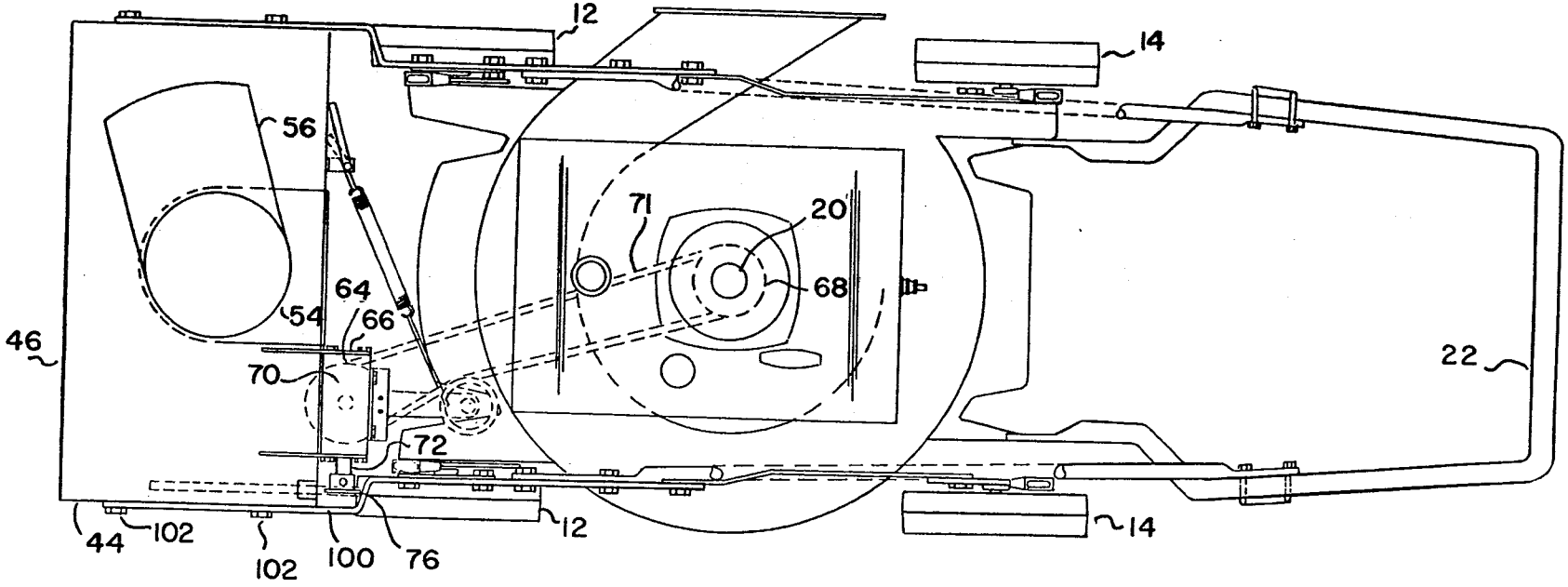
FIG. 2 is a top view of the equipment shown in FIG. 1.

The snow blower adapter of the present invention includes a housing 44, as shown in FIGS. 1 and 2 of the drawings. The housing defines a forward opening 46 adapted to receive snow as the assembly is advanced in a forward direction. For that purpose, the forward opening includes an upper mouth portion 48 which serves to deflect snow into the central opening 46. Mounted within the housing 44 is a conventional conveyor or auger means 50 rotatably mounted by means of a shaft 52 in accordance with conventional techniques. The auger 50 thus serves to displace snow fed into the central opening 46 for removal.

As will be understood by those skilled in the art, conveyor means other than the auger 50 illustrated in the drawings can be used in the practice of this invention. For example, it is also possible to employ as the conveyor a rotatable shaft carrying one or more snow deflection blades. As the shaft is mounted, the snow deflection blades rotate with the shaft to deflect the snow upwardly through suitable snow directing means such as the chute 56 or like guide members to insure that the snow is displaced in the desired direction.

The housing 44 also defines exist means 54 positioned on the upper portion thereof, on which there is mounted a rotatable chute 56 through which snow is expelled from the housing 44 by means of the auger 50. As has become standard practice is snow blowing equipment, the snow blower chute 56 is rotatable about the opening 54 so that the discharge chute 56 can be directed in any direction to displace snow out of the way. For that purpose, it is frequently desirable to form the opening 54 with a flange 58 having an annular lip 60 adapted to engage a corresponding annular lip 62 on the lower end of the chute 56. In that way, the chute 56 can be quickly snapped into position over the annular projection 60 of the opening 54.

It is an important concept of the present invention that the snow blower adapter be provided with a self-contained transmission. For that purpose, there is mounted on the housing 44 a transmission 64. As is perhaps most clearly shown in FIGS. 2 and 4 of the drawing, the transmission 64 is mounted on the housing 44 by means of a U-shaped bracket 66. The transmission 64 thus includes means to transmit power from the motor means 18 to drive the auger 50.

In the preferred embodiment of the invention, the transmission of the power from the power means 18 is effected by means of a pulley 68 mounted on the shaft of the power means 18 which in turn drives a belt 71. In one embodiment of the invention, it has been found that best results are usually obtained when the shaft 20 is also provided with a fly wheel 21 mounted thereon to increase the angular momentum of the shaft 20 and consequently the torque applied to the transmission 64. A corresponding pulley 70, also carrying the belt 71, is carried on the lower end of the transmission 64 to drive the transmission through a shaft 72. The transmission also includes an output shaft 74 which drives a pulley 76 which is operatively connected by means of a belt or chain 78 which in turn drives a sprocket or pulley 80 fixed to the auger 50.

The transmission 64 is engaged by means of a clutch wheel 82. As is shown most clearly in FIGS. 3 and 4 of the drawing, the clutch wheel 82 is mounted on a pivotal arm 84 which in turn is carried by a U-shaped bracket 86 mounted on the transmission 64 by means of a pin 88. Thus, when it is desired to engage the transmission 64, the arm 84 is pivoted so that the clutch wheel 82 engages the belt 71 and provides tension in the belt 71 so that the pulley 68 drives the belt 71 which in turn drives the pulley 70. The clutch wheel 82 is pivoted into position by means of a spring 90 operatively connected to a tie rod 92. At its end opposite the clutch wheel 82, the clutch spring 90 includes a control lever 94 which imparts a tension to the spring 90 when displaced in the direction shown by the arrow in the drawing. For that purpose, the control lever 94 is pivotally mounted on a bracket 96 mounted on the housing 44.

Figure 5:
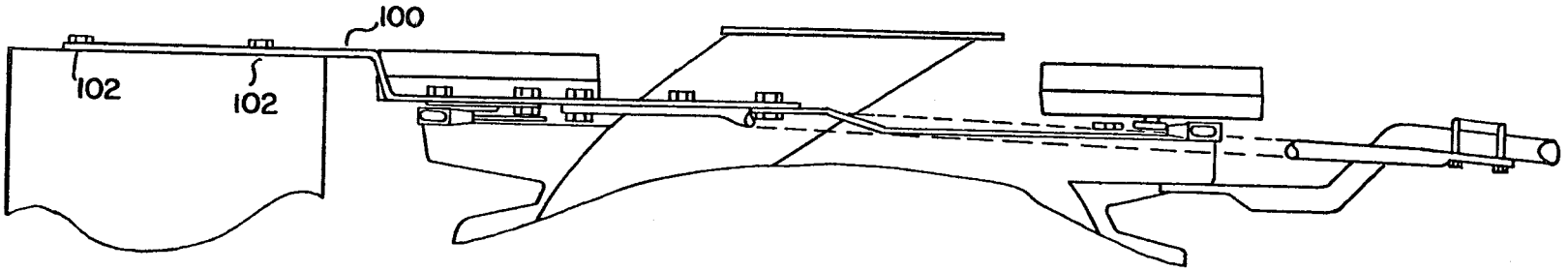
FIG. 5 is a detailed view of the mounting brackets employed with the snow blowing adapter of the present invention, as viewed in a top view.
Figure 6:
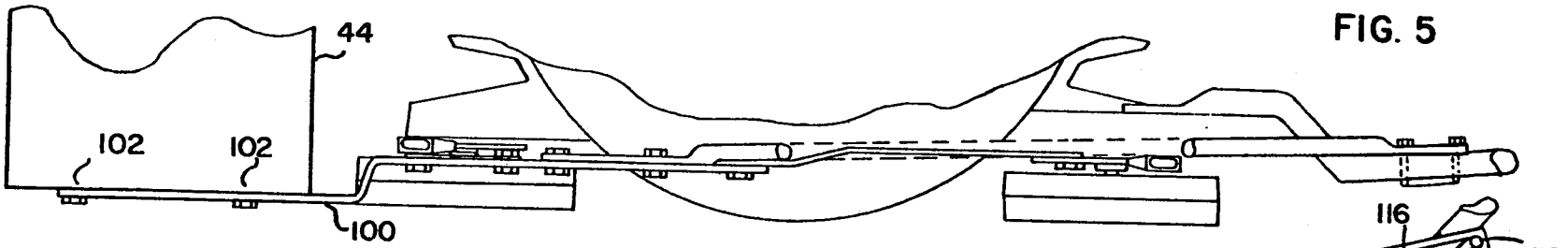
FIG. 6 is a side view in elevation of a mounting bracket shown in FIG. 5.
Figure 6:
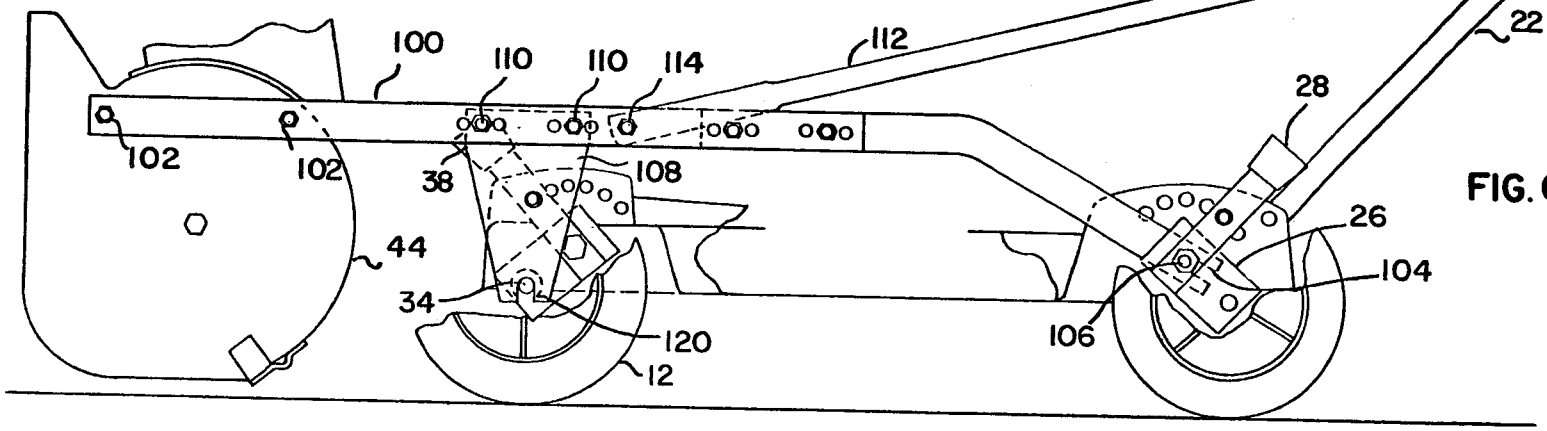

The mounting brackets on which the snow blower adapter is mounted to the chassis 16 of the lawn mower are best illustrated in FIGS. 1, 5 and 6 of the drawing. As can be seen in these figures, the mounting bracket includes a pair of elongate arms 100 fixed to the housing 44 by fastening means 102. On their rearward ends, the elongate arms 100 are fixed to the flanges 26 carrying the rear wheels. For that purpose, the rearward end of the elongate arm 100 may be provided with a slotted end portion 104 to which the elongate arm 100 is fastened by means 106 to the flange 26 at the point at which the height control lever 28 is fastened to the flange 26. In this way, the function of the height control lever 28 remains to control the height of the snow blower above the ground surface.

While the invention is described in FIGS. 1 and 6 as having the slotted end portion 104 of the elongate arms engaging the rear wheels at the point at which the control lever 28 is mounted on the rear flange 26, it is also possible to mount the snow blower adapter on the lawn mower 10 by engaging the slotted end portion 104 with the rear axle 24.

The elongate arms 100 are also fastened to a forward flange 108 by means 110. The forward flange 108 is carried by the front axle 34 of the front wheel 12 to support a portion of the weight of the snow blower housing 44. Thus, the height of the housing 44 above the ground surface is also regulated by means of the forward control lever 38 since the forward flange member 108 is carried by the axle of the forward wheel 12.

To insure the desired structural strength, the elongate arm 100 may also be provided with an adjustable bar 112 mounted on the elongate arm by fastening means 114 just to the rear of the forward wheels. The other end of the adjustable bar 112 may be fixed to the handle 22 by means of a slot 116 through which bolts 118 extend to secure the end of the arm 112 to the handle 22.

Thus, it will be observed that the snow blower attachment of this invention can be mounted on a conventional lawn mower in a simple and efficient manner. All that need be done is that the blade carried on the shaft 20 of the motor means 18 be removed, and replaced by the pully 68, the belt 71 being attached thereto. Then, the forward flange 108 with its notch 120 positioned to engage the axle 34 of the forward wheels 12 and the slot 104 of the rearward portion of arm 100 engage with the control levers 28 and secured therto. The bar 112 is put in position in the assembly of the snow blowing attachment.

Alternative mounting means are shown in FIGS. 7–14 of the drawings. As shown in these figures, the power-driven lawn mower 10 is provided with a pair of front wheels 12 mounted upon the chassis 16. In this particular embodiment, the power-driven lawn mower 10 is particularly adapted to carry a snow blowing adapter of the present invention. Included for this purpose are a pair of raised portions 130 integral with the chassis 16 adjacent to the front wheels 12. The raised portions 130 each include a central opening 132 extending through the chassis 16. Parallel to and opposite sides of the raised portion 130 are a pair of elongate slits 134 adapted to receive a portion of the snow blower adapter mounting means hereinafter described.

Figures 7, 8, 9, 10, 11, 12, 13, 13A, 14, 14A:
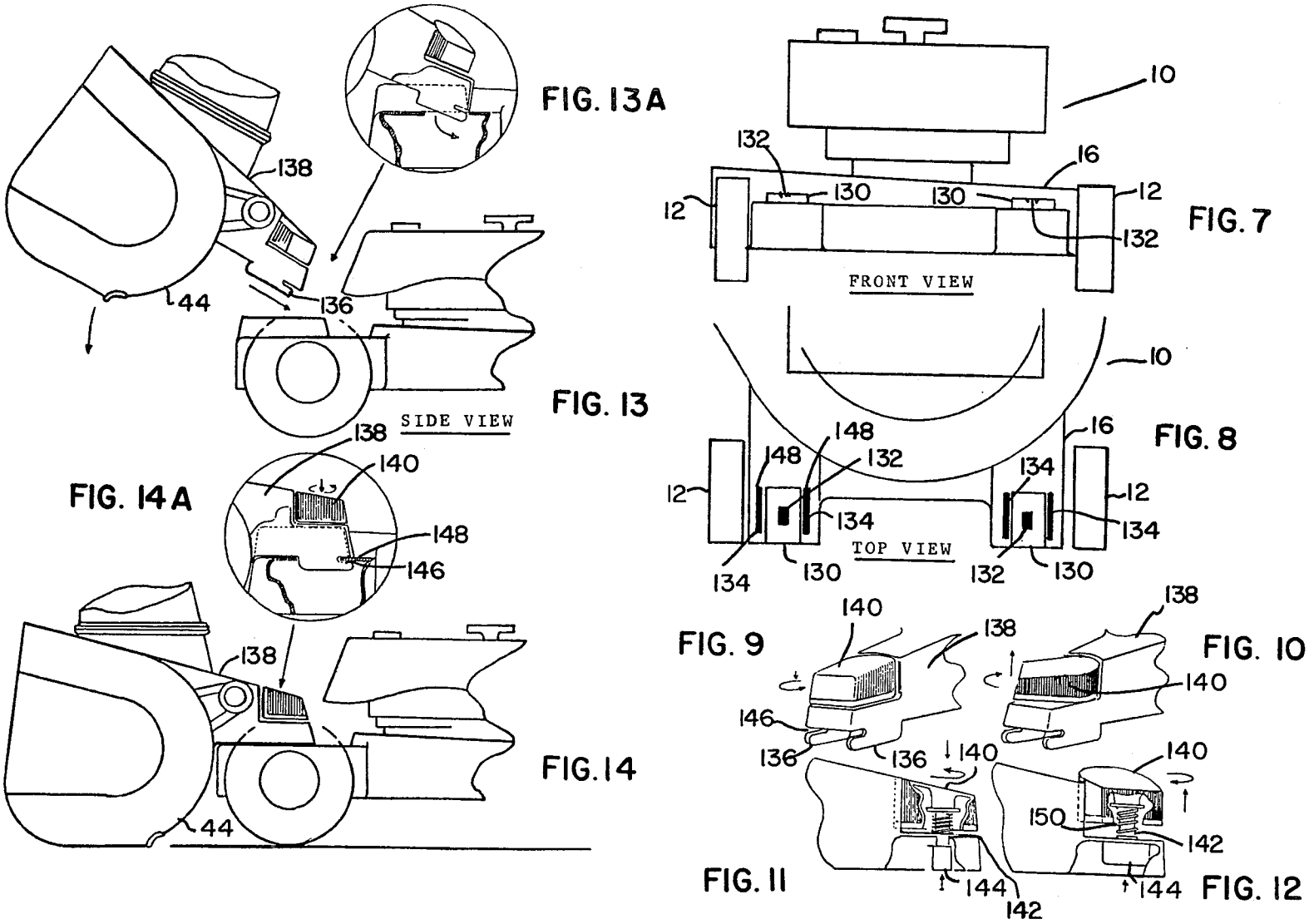
FIG. 7 is a front view in elevation of a powerdriven lawn mower including alternative mounting means for receiving the snow blower adapter of the invention.
FIG. 8 is a partial top view of the lawn mower illustrated in FIG. 7.
FIGS. 9–12 illustrate alternative mounting means useful in the practice of this invention for mounting the snow blower adapter on a lawn mower of the type shown in FIGS. 7 and 8.
FIG. 13 illustrates the mounting of the snow blower adapter of this invention on a lawn mower of the sort illustrated in FIGS. 7 and 8.
FIG. 14 illustrates the snow blower adapter of the invention mounted on a lawn mower of the type illustrated in FIGS. 7 and 8.

Suitable mounting means for use with the snow blower adapter of this invention are illustrated in detail in FIGS. 9–12 of the drawing. As shown in these figures, the mounting means include a pair of spaced parallel projections 136 integral with a mounting arm 138, the projections 136 being adapted to be received in the elongate slits 134. The mounting arm 138 also includes a rotatable fastening element generally shown as 140. This fastening element 140 is shown in greatest detail in FIGS. 11 and 12 of the drawing. It is there described that the rotatable fastening element 140 is mounted on a shaft 142 which, in turn, carries a lock nut 144 on the opposite end thereof. The lock nut is determined to correspond, when the fastening means 140 is in the rotated position as illustrated in FIG. 10, to the central openings 132 of the raised portions 130 of the power driven lawn mower. Thus, as the fastening means 140 is rotated to the position shown in FIG. 9, the lock nut 144 is likewise rotated so that it is no longer in a position to be removed from the central recess 132 of the raised portion 130. This can be conveniently accomplished by providing the lock nut 144 with a size and shape corresponding to the central opening 132. As the fastening means 140 is rotated to the position as shown in FIG. 9, the lock nut 144 is likewise rotated by means of the shaft 142 so that the lock nut is skewed relative to the opening 132, and consequently cannot be removed therefrom.

The use of the fastening means illustrated in FIGS. 7–12 is illustrated in FIGS. 13 and 14 of the drawing. As can be seen from those figures, the mounting arms 138 are fixed in any desired manner to the snow blower housing 44. To mount the snow blower adapter on the power driven lawn mower, the projections 136 are inserted into the elongated slits 134, with the space 146 defined by the projections 136 engaging the trailing edge 148 of the elongate slits 134. At the time that the projections are inserted into the slits 134, the fastening member 140 is rotated (as shown in FIG. 10 of the drawing) such that the lock nut 144 is aligned with the central opening 132 on the raised portion 130 of the mower housing 16. Then as is shown in FIG. 14A, the fastening member 140 is rotated to the position shown in FIG. 9 of the drawing, where the lock nut 144 is skewed relative to the central opening 132 and thereby secures the mounting arm 138 onto to mower housing 16.

In the preferred practice of this embodiment of the invention, the lock nut 144 is biased from the fastening means 140 by means of a spring 150 as shown in FIG. 12 of the drawing. The spring 150 thus insures that the lock nut 144 will be drawn taut in a skewed position after it has been inserted through the central opening 132.

Figures 3, 4:
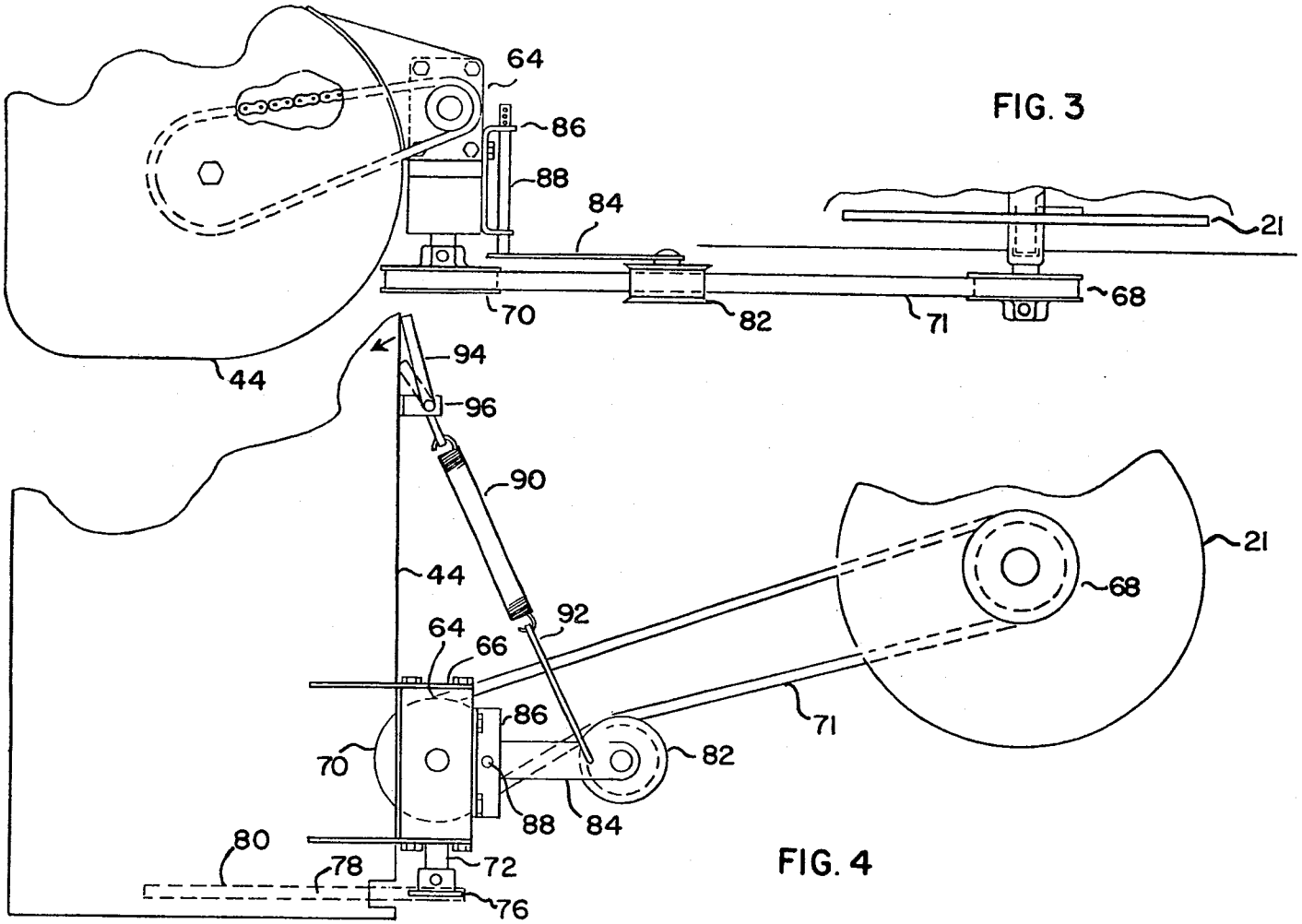
FIG. 3 is a detailed view of the power train of the snow blowing attachment of the present invention as operatively connected with the lawn mower, inside elevation.
FIG. 4 is a bottom view of the power train illustrated in FIG. 3.
Figure 16:
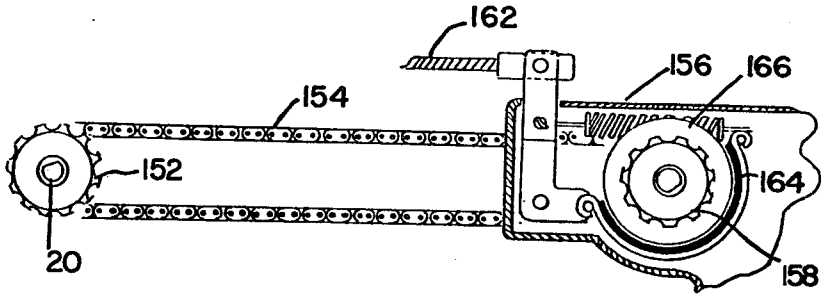
FIG. 16 is a sectional view taken along the lines A—A in FIG. 15.
Figure 15:
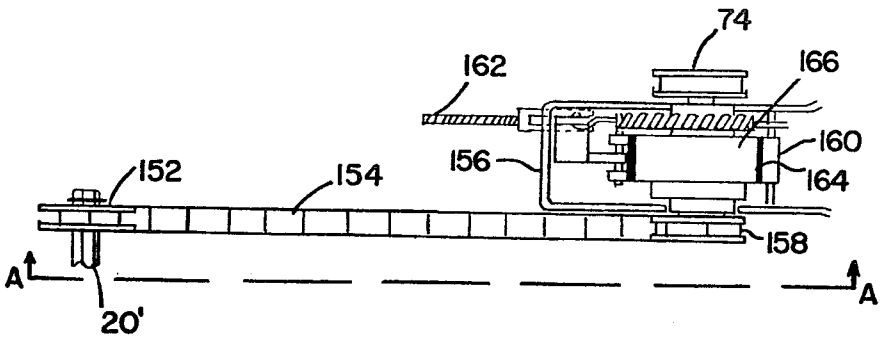
FIG. 15 is a view in elevation of an alternative transmission useful in the practice of this invention.

FIGS. 15–22 illustrate alternative transmission means which can be employed in the practice of this invention in lieu of that specifically described in FIGS. 3 and 4 of the drawing. The embodiment shown in FIGS. 15 and 16 illustrates a transmission with a friction clutch, the details of which are well known to those skilled in the art and, per se, form no part of the present invention. As is shown in these two figures, the lawn mower shaft 20 carries a gear wheel 152 which in turn carries a chain drive means 154 to supply power to the clutch assembly generally designated as 156. The clutch assembly 156 includes a driven gear wheel 158 which is operatively connected to the output pulley 74 as described above by means of a friction clutch 160. Thus, as the clutch is engaged by means of an actuating member 162, the friction is generated by means of the clutch lining 164 to cause the clutch wheel 166 to rotate with the gear 158. That in turn causes gear 158 to rotate with the output pulley 74 to drive the auger of the snow blower adapter.

The transmission means illustrated in FIGS. 15 and 16 are particularly well suited where the power driven lawn mower includes a power takeoff shaft 20' extending from the side thereof, as is now conventional in the lawn mower art.

Figure 17:
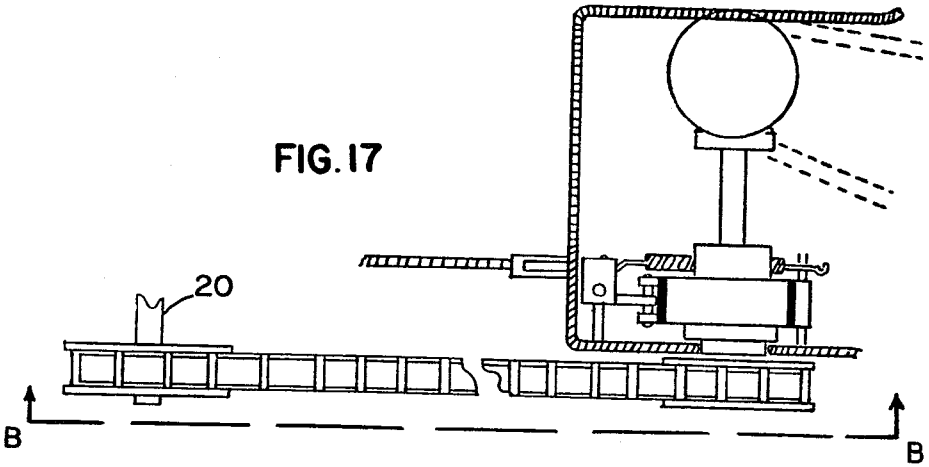
FIG. 17 is still another transmission means suitable for use in the practice of this invention.
Figure 18:
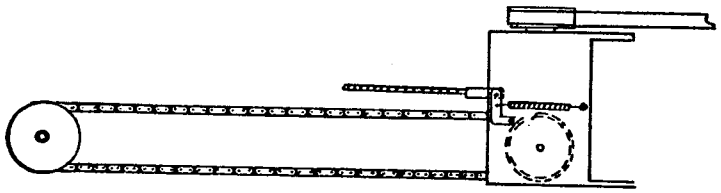
FIG. 18 is a sectional view taken along the lines B—B in FIG. 17.

Where, however, the lawn mower is not equipped with a side shaft providing a power takeoff capability, the transmission means of FIGS. 15 and 16 can simply be redesigned as shown in FIGS. 17 and 18 whereby the shaft 20 from the lawn mower power supply is vertically mounted beneath the mower engine 18. The transmission means shown in FIGS. 17 and 18 is otherwise the same as that illustrated in FIGS. 15 and 16.

Figure 19:
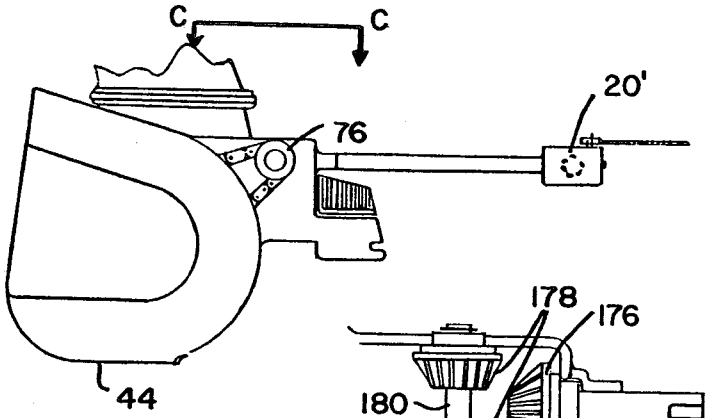
FIG. 19 is a side view in elevation of another transmission means useful in the practice of this invention.
Figure 20:
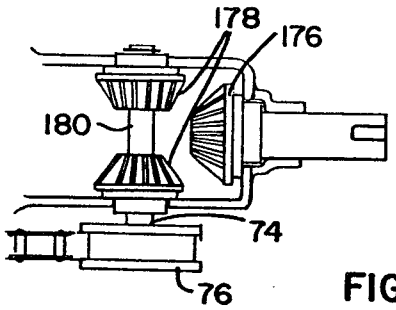
FIG. 20 is an exposed view taken along the lines C—C in FIG. 19.
Figure 20A:
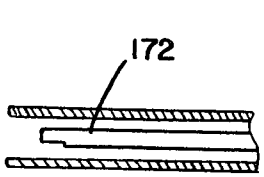
FIG. 20A is an exposed view of the control means utilized in FIG. 19.
Figure 20A:
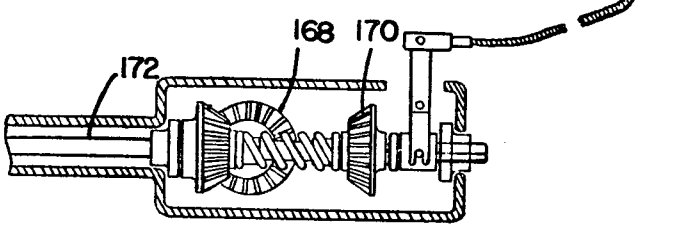

Another alternative transmission means is shown in FIGS. 19, 20 and 20A of the drawing. There is shown in these figures an alternative means for supplying power from a lateral power takeoff shaft 20' to the snow blower adapter embodying the features of this invention. As can be seen from these figures, the power takeoff shaft 20' drives a gear wheel 168 which in turn engages a gear wheel 170 and consequently an elongate shaft 172 when the gear wheel 170 is advanced in a forward direction (right to left as shown in FIG. 20A) by means of a control lever 174. As the gear wheel 170 and the elongate shaft 172 are advanced in a forward direction such that the gear wheel 170 engages the drive shaft 168, another gear wheel 176 mounted on the opposite end of the shaft 172 (as shown in FIG. 20) is advanced to mesh with a pair of gear wheels 178 mounted on a shaft 180 to drive an output shaft 74 and its accompanying output pulley 76 to drive the conveyor means of the snow blower adapter as described above.

Figure 21:
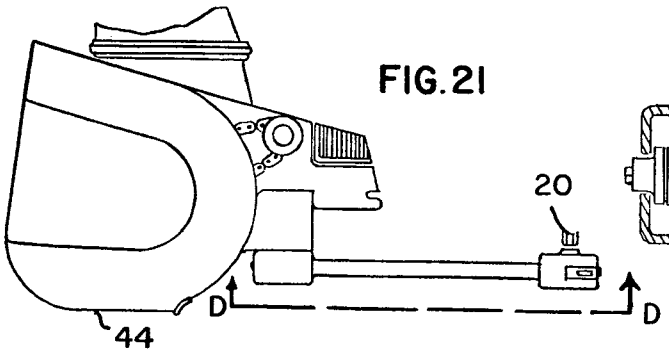
FIG. 21 is an alternative transmission means useful in the practice of this invention.
Figure 22:
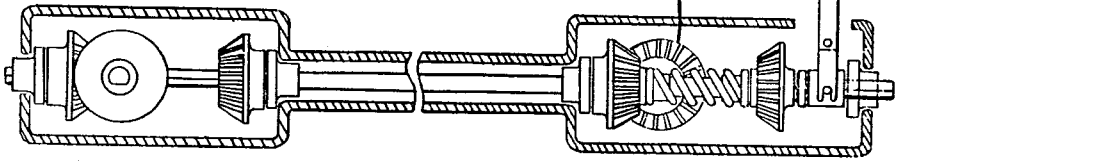
FIG. 22 is an exposed sectional view taken along the lines D—D of FIG. 21.

The embodiment shown in FIGS. 21 and 22 of the drawing is the same, except that in this embodiment the input shaft 20 is positioned beneath the lawn mower engine 18 as illustrated in FIG. 1 of the drawing.

It will be understood that various changes and modifications can be made in the details of structure, operation and use without departing from the spirit of the invention, especially as defined in the following claims.

I claim:

1. A snow blower adapter for use with a powered lawn mower having a pair of front wheels and and a pair of rear wheels, said adapter comprising a housing defining a forward opening adapted to receive snow therein, chute means in the housing positioned to displace snow therefrom, conveyor means in the housing to convey snow received in the central opening to the chute means and to expel snow therefrom, means to drive the conveyor means, said means to drive the conveyor means including transmission means adapted to drive the conveyor means by power received from the lawn mower and clutch means to operatively engage and disengage the transmision from the lawn mower, and mounting means for removably mounting the adapter on a powered lawn mower, said mounting means including a pair of elongate arms carrying the housing and having lawn-mower engaging means positioned opposite said housing, said engaging means including a slotted portion on said arms adapted to removably engage said rear wheels of the lawn mower to thereby secure said housing to the lawn mower.

2. A snow blower as defined in claim 1 wherein the transmission includes belt means operatively connected to the lawn mower to drive the transmission and a clutch means, adapted to engage the transmission by imparting to the belt means a tension thereto whereby the power from the lawn mower drives the transmission through said belt means.

3. A snow blower as defined in claim 2 wherein the clutch means includes a rotatable wheel positioned to releasably engage and disengage said belt means, said wheel being pivotally mounted and including spring means to bias the wheel in engagement with the belt means to impart tension thereto.

4. A snow blower as defined in claim 1 wherein the mounting means also includes a pair of opposing forward flange members adapted to be mounted on the front wheels of the lawn mower.

5. In combination, a snow blower mounted on a powered lawn mower which includes a pair of front and rear wheels, a chassis, a handle and power means mounted on the chassis, said power means including a drive shaft, the improvement comprising a snow blower adapter mounted on the lawn mower, the snow blower adapter comprising a housing defining a forward opening adapted to receive snow therein, chute means in the housing positioned to displace snow therefrom, conveyor means in the housing to convey snow received in the central opening to the chute means and to expel snow therefrom, means to drive the conveyor means, said means to drive the conveyor means including transmission means adapted to drive the conveyor means by power received from the lawn mower and clutch means to operatively engage and disengage the transmission from the lawn mower, and mounting means for removably mounting the adapter on a powered lawn mower, said mounting means including a pair of elongate arms carrying the housing and having lawn-mower engaging means positioned opposite said housing, said engaging means including a slotted portion on said arms adapted to removably engage said rear wheels of the lawn mower to thereby secure said housing to the lawn mower.

6. The combination as defined in claim 5 wherein the shaft includes a fly wheel mounted thereon and means adapted to be engaged with the transmission of the snow blower adapter.

7. The combination as defined in claim 5 wherein the transmission includes belt means operatively connected to the lawn mower to drive the transmission and a clutch means, adapted to engage the transmission by imparting to the belt means a tension thereto whereby the power from the lawn mower drives the transmission through said belt means.

8. The combination as defined in claim 7 wherein the clutch means includes a rotatable wheel positioned to releasably engage and disengage said belt means, said wheel being pivotally mounted and including spring means to bias the wheel in engagement with the belt means to impart tension thereto.

9. The combination as defined in claim 5 wherein the mounting means also includes forward flange members extending from the elongate arms to removably engage the front wheels of the lawn mower and secure the elongate arms thereto.

10. The combination as defined in claim 5 which includes a pair of adjustable bars extending from the elongate arms to the handle of the lawn mower to provide additional structural strength.

11. The combination as defined in claim 5 wherein the lawn mower includes an adjustable pair of flanges, the rear wheels of the lawn mower being mounted on said flanges, said lawn mower also including a pair of control levers, said control levers being mounted on said flanges, with the slotted portion of said elongate arms engaging said control levers and the pair of flanges whereby adjustment in the height of the lawn mower with the control lever operates to adjust the height of the snow blower adapter.

12. In combination, a snow blower mounted on a powered lawn mower which includes a pair of front and rear wheels, a chassis and power means mounted on the chassis, said power means including a drive shaft, the improvement comprising a snow blower adapted mounted on the lawn mower, the snow blower adapter comprising a housing defining a forward opening adapted to receive snow therein, chute means in the housing positioned to displace snow therefrom, conveyor means in the housing to convey snow received in the central opening to the chute means and to expel snow therefrom, means to drive the conveyor means, said means to drive the conveyor means including transmission means adapted to drive the conveyor means by power received from the lawn mower and clutch means to operatively engage and disengage the transmission from the lawn mower, and mounting means for removably mounting the adapter on a powered lawn mower, said mounting means including a pair of elongate arms carrying the housing and having lawn-mower engaging means positioned opposite said housing, said engaging means including a slotted portion on said arms adapted to removably engage said rear wheels of the lawn mower to thereby secure said housing to the lawn mower.

13. The combination as defined in claim 12 wherein the mounting means also includes a pair of opposing forward flange members adapted to be mounted on the front wheels of the lawn mower.

14. A snow blower adapter for use with a powered lawn mower and a pair of front wheels and a pair of rear wheels and having a chassis, said chassis having a plurality of slotted openings in the chassis adjacent the front wheels, said adapter comprising a housing defining a forward opening adapted to receive snow therein, chute means in the housing positioned to displace snow therefrom, conveyor means in the housing to convey snow received in the central opening to the chute means and to expel snow therefrom, means to drive the conveyor means, said means to drive the conveyor means including transmission means adapted to drive the conveyor means by power received from the lawn mower and clutch means to operatively engage and disengage the transmission from the lawn mower, mounting means for removably mounting the adapter on said powered lawn mower, said mounting means including a pair of elongate arms carrying the housing and having lawn mower engaging means positioned opposite the housing, said engaging means including a pair of spaced parallel projections adapted to be received in said slotted openings on the lawn mower housing to secure the elongate arms to said chassis, and means for releasably locking said elongate arms to the lawn mower chassis.

15. In combination, a snow blower mounted on a powered lawn mower which includes a pair of front and rear wheels, a chassis and power means mounted on the chassis, said power means including a drive shaft, the improvement comprising a snow blower adapter mounted on the lawn mower, the snow blower adapter comprising a housing defining a forward opening adapted to receive snow therein, chute means in the housing positioned to displace snow therefrom, conveyor means in the housing to convey snow received in the central opening to the chute means and to expel snow therefrom, means to drive the conveyor means, said means to drive the conveyor means including transmission means adapted to drive the conveyor means by power received from the lawn mower and clutch means to operatively engage and disengage the transmission from the lawn mower, mounting means for removably mounting the adapter on said powered lawn mower, said mounting means including a pair of elongate arms carrying the housing and having lawn mower engaging means positioned opposite the housing, said engaging means including a pair of spaced parallel projections adapted to be received in said slotted openings on the lawn mower housing to secure the elongate arms to said chassis, and means for releasably locking said elongate arms to the lawn mower chassis.

* * * * *